US009111708B2

(12) United States Patent
Onoda

(10) Patent No.: US 9,111,708 B2
(45) Date of Patent: Aug. 18, 2015

(54) FUSIBLE LINK

(75) Inventor: Shinya Onoda, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 12/796,119

(22) Filed: Jun. 8, 2010

(65) Prior Publication Data

US 2010/0315192 A1 Dec. 16, 2010

(30) Foreign Application Priority Data

Jun. 10, 2009 (JP) ..... P. 2009-138991

(51) Int. Cl.
*H01H 85/10* (2006.01)
*H01H 85/11* (2006.01)
*H01H 85/47* (2006.01)

(52) U.S. Cl.
CPC ..... *H01H 85/10* (2013.01); *H01H 85/11* (2013.01); *H01H 85/47* (2013.01)

(58) Field of Classification Search
CPC ..... H01H 85/11; H01H 85/47
USPC ..... 337/163, 152, 160, 416
See application file for complete search history.

(56) References Cited

U.S. PATENT DOCUMENTS 4,944,084 A * 7/1990 Horibe et al. ..... 29/623
4,958,426 A * 9/1990 Endo et al. ..... 29/623
5,262,751 A 11/1993 Kudo et al.
5,294,906 A * 3/1994 Totsuka et al. ..... 337/260
5,398,015 A 3/1995 Kudo et al.
5,488,346 A * 1/1996 Kondo et al. ..... 337/198
5,528,213 A * 6/1996 Kondo et al. ..... 337/160
5,546,066 A * 8/1996 Kondo et al. ..... 337/163
5,581,225 A * 12/1996 Oh et al. ..... 337/295
5,661,448 A * 8/1997 Totsuka et al. ..... 337/160
5,668,522 A * 9/1997 Kondo et al. ..... 337/198
5,739,741 A * 4/1998 Hanazaki et al. ..... 337/290
5,745,023 A * 4/1998 Totsuka ..... 337/160
5,745,024 A * 4/1998 Ohta et al. ..... 337/166

(Continued)

FOREIGN PATENT DOCUMENTS

JP 5-166453 7/1993
JP UM-H06-48149 A 6/1994

(Continued)

OTHER PUBLICATIONS

English machine translation of JP/2004-127,701 (Apr. 22, 2004).*

(Continued)

*Primary Examiner* — Anatoly Vortman
(74) *Attorney, Agent, or Firm* — Finnegan, Henderson, Farabow, Garrett & Dunner, L.L.P.

(57) ABSTRACT

A fusible link includes a fuse portion that has a first resistance portion and a second resistance portion which are formed of a fusible metal conductor. The first resistance portion has a fusible portion which is provided in proximity to a connecting portion of the first resistance portion with the second resistance portion. The fusible link further includes a metal chip whose melting point is lower than a melting point of the fusible metal conductor. A ratio of resistance values of the first resistance portion and the second resistance portion is set so that a heat concentration portion of the fuse portion whose temperature is increased by an overcurrent in a rare-short-circuit range is shifted to a part of the first resistance portion which excepts the fusible portion.

15 Claims, 5 Drawing Sheets

(56) References Cited

U.S. PATENT DOCUMENTS

| | | | | |
|---|---|---|---|---|
| 5,748,067 | A * | 5/1998 | Ishii et al. | 337/160 |
| 5,752,310 | A * | 5/1998 | Kondo et al. | 29/623 |
| 5,821,847 | A * | 10/1998 | Totsuka | 337/166 |
| 5,883,560 | A * | 3/1999 | Nakamura et al. | 337/160 |
| 6,294,978 | B1 * | 9/2001 | Endo et al. | 337/166 |
| 6,529,113 | B2 * | 3/2003 | Endo et al. | 337/198 |
| 6,570,482 | B2 * | 5/2003 | Brown et al. | 337/160 |
| 6,791,448 | B2 * | 9/2004 | Kaltenborn et al. | 337/160 |
| 2001/0043139 | A1 | 11/2001 | Endo et al. | |
| 2009/0066470 | A1 | 3/2009 | Miyamoto | |

FOREIGN PATENT DOCUMENTS

| | | |
|---|---|---|
| JP | A-H07-14494 | 1/1995 |
| JP | 2001-325875 | 11/2001 |
| JP | 2004-127701 | 4/2004 |
| JP | A-2007-287655 | 11/2007 |

OTHER PUBLICATIONS

Korean Office Action dated Jul. 28, 2011, in Korean Application No. 10-2010-0054159 and English translation thereof (9 pages).

Japanese Notification of Reasons for Refusal in Counterpart Application No. 2010-130986, dated Feb. 13, 2014.

Official Action issued by Japanese Patent Office on Sep. 8, 2014 in the counterpart Japanese Application No. 2010-130986, and English translation thereof Yes.

* cited by examiner

FUSIBLE LINK

CROSS-REFERENCE TO RELATED APPLICATIONS

The present application is based on Japanese Patent Application No. 2009-138991 filed on Jun. 10, 2009, the contents of which are incorporated herein for reference.

BACKGROUND

The present invention relates to a fusible link and more particularly to a fusible link which is not fused or melted by an overcurrent in a rare-short-circuit range.

Conventionally, fusible links (F/L) with an overcurrent of 200% or more of a conducted, or rated, current have been used as a protective fuse for an electric circuit such as a motor load circuit through which an overcurrent flows. For this purpose, fusible links with an overcurrent of 200% or more have been demanded to efficiently protect such an electric circuit when a burst current (a dead-short-circuit occurs) is generated. Namely, a current range is divided based on a boundary value. A current flowing at the boundary value is as large as twice a rated value. A dead-short-circuit range is a current range larger than the boundary value and a rare-short-circuit range is a current range smaller than the boundary value. A fuse having characteristics which are effective for both the dead-short-circuit range and the rare-short-circuit range is demanded.

When a large overcurrent flows as when a dead-short-circuit occurs, a fusible link needs to ensure the interruption of a load circuit before the circuit is damaged or a lead wire connected to the load circuit is fused or fumes. In addition, for example, when an electric powered window of a motor vehicle is opened or closed, although a motor lock current, in an intermediate current range, flows through a circuit with an overcurrent of 200% or less for on the order of about 10 seconds, the circuit needs to be prevented from being interrupted easily even though the motor lock current flows frequently.

As a fuse having characteristics like those described above, there has been proposed a fuse which includes a pair of connecting portions which are opposed to each other, and a fusible element portion (a fuse portion) which is provided at an intermediate portion of one of the connecting portions and fixes a metal chip by a surrounding attachment portion (refer to Patent Document 1, for example). Here, the metal chip is a linear material which is produced by extruding a low melting point metal into a linear shape and cutting it to a predetermined length, and the fusible element portion is made up of a plate-shaped fusible metallic conductor. A base material of the fusible element portion is an alloy of copper which constitutes a conductor wire, and the fusible element portion is made to be fused momentarily when a large current flows through a cross-sectional area which is smaller than an other portion. On the other hand, the material of the metal chip is tin (Sn) whose melting point is lower than that of copper (Cu), and when electrified, the metal chip heats and melts to be dispersed within the fusible element portion for formation of an alloy phase. Therefore, in the small current range to intermediate current range, the fusible element portion is fused in the alloy phase whose resistance is higher than that of the copper alloy which constitutes the base material thereof. In this way, the fuse having the low melting point metal such as tin or alloy containing tin as its main constituent changes its fusing time with respect to conducted current depending upon the mass of tin. Conventionally, the fuse of this type utilizes a solid metal chip, and the fusing characteristics thereof have been controlled by changing the dimensions of the solid metal chip utilized.

In the conventional fuse that has been described above, however, when an overcurrent in the rare-short-circuit range (for example, a small current range when overcurrent is on the order of 110%) flows, the dispersion of tin is progressed by Joule heat and the alloy phase is formed, whereby the fuse becomes easy to be fused or heated. Because of this, it becomes difficult for the fuse to be kept unmelted for a long period of time (for example, 10 hours or longer).

[Patent Document 1] JP-A-5-166453

SUMMARY

The invention has been made in these situations and an object thereof is to provide a fusible link having fusing characteristics which prevent it from being fused when an overcurrent in the rare-short-circuit range flows.

In order to achieve the above object, according to the present invention, there is provided a fusible link comprising:

a fuse portion that has a first resistance portion and a second resistant portion which are formed of a fusible metal conductor, wherein the first resistance portion has a fusible portion which is provided in proximity to a connecting portion of the first resistance portion with the second resistance portion and which is adapted to be fused and cut off when the fusible portion is heated up by an overcurrent;

a metal chip whose melting point is lower than a melting point of the fusible metal conductor, and which is adapted to be fused to be dispersed into the fusible portion for formation of an alloy phase when the metal chip is heated up by the overcurrent; and a holding portion that is provided in proximity to the fusible portion for holding the metal chip, wherein a ratio of resistance values of the first resistance portion and the second resistance portion is set so that a heat concentration portion of the fuse portion, whose temperature is increased by the overcurrent in a rare-short-circuit range, is shifted to a part of the first resistance portion which excepts the fusible portion.

Preferably, the ratio of resistance values of the first resistance portion and the second resistance portion is set so that heat generated at the part of the first resistance portion which excepts the fusible portion is greater than the heat generated at the fuse portion.

Preferably, the ratio of the resistance value of the first resistance portion to the resistance value of the second resistance portion ranges from 2 to 1 to 5 to 1.

Preferably, an overcurrent in the rare-short-circuit range is 110% of a rated value.

Preferably, quick blow characteristics, for a case where an overcurrent in a dead-short-circuit range flows, is set based on the ratio of the resistance value of the first resistance portion to the resistance value of the second resistance portion. Also, the overcurrent in the dead-short-circuit range is greater than the overcurrent in the rare-short-circuit.

Preferably, a cross-sectional area of the fusible portion is smaller than that of the part of the first resistance portion which excepts the fusible portion.

According to the invention, the fusible link having fusing characteristics, in which the fusible portion is not fused when the overcurrent in the rare-short-circuit range flows therethrough, can be provided.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
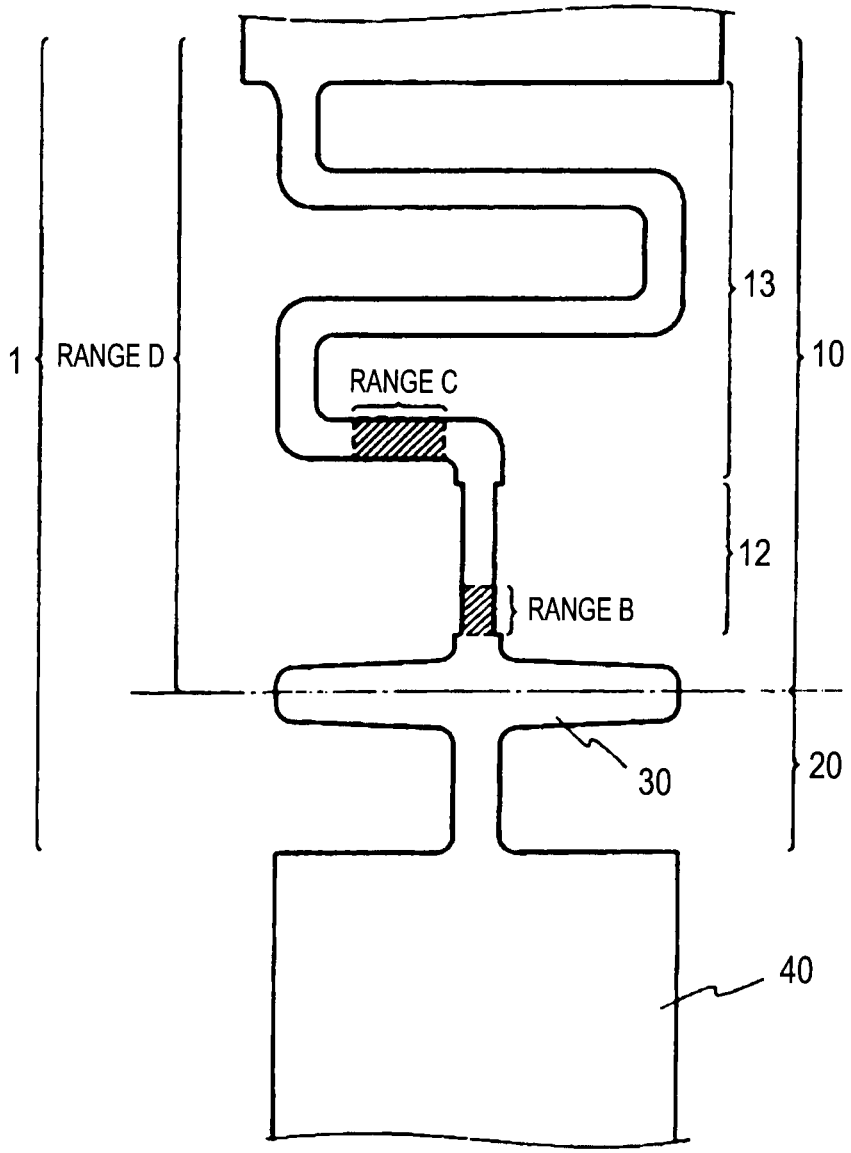
FIG. 1 is an exemplary plan view of a fusible link according to an embodiment of the invention.

Hereinafter, an embodiment of the invention will be described by reference to the drawings. In the accompanying drawings, like or similar portions are denoted by like or similar reference numerals. However, the drawings are exemplary, and a relationship between thickness and dimensions as viewed from the top and a ratio of thicknesses of respective layers are different from those in reality. Consequently, specific thicknesses and other dimensions should be judged by referring to the following description. In addition, the same dimensional relationships or ratios may, of course, be illustrated differently between the accompanying drawings.

Embodiment

Figure 2:
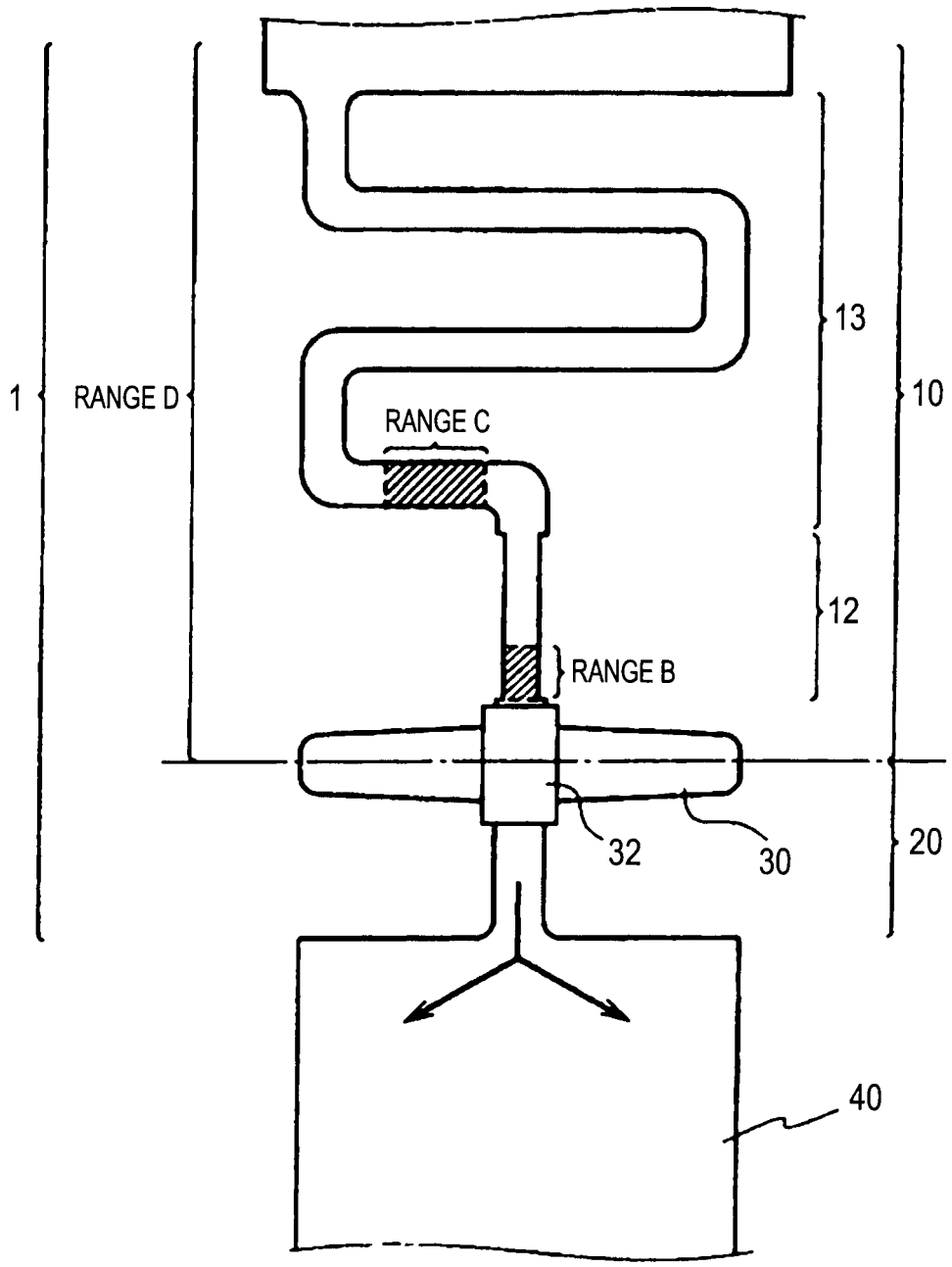
FIG. 2 is an exemplary plan view of the fusible link according to the embodiment of the invention.

As is shown in FIGS. 1 and 2, a fusible link according to an embodiment of the invention includes a fuse portion 1, a low melting point metal chip 32, and a holding portion 30. The fuse portion 1 has a first resistance portion 10 and a second resistance portion 20. The first resistance portion 10 and the second resistance portion 20 are each formed of a fusible conductor. The fuse portion 1 has a fusible portion 12 which is provided in proximity to a connecting portion of the first resistance portion 10 with the second resistance portion 20. The fusible portion 12 is adapted to be broken when the fusible portion 12 is heated up by an overcurrent. The low melting point metal chip 32, whose melting point is lower than that of the fusible metal conductor, is adapted to be dispersed into the fusible portion 12 for formation of an alloy phase when the low melting point metal chip 32 is heated up by the overcurrent. The holding portion 30 is provided in proximity to the fusible portion 12 and holds the low melting point metal chip 32. Resistance values of the first resistance portion 10 and the second resistance portion 20 are set to a ratio so that a heat concentration portion of the fuse portion 1, whose temperature is increased by an overcurrent in the rare-short-circuit range, is shifted to a portion (a non-fusible portion 13) of the first resistance portion 10 except the fusible portion 12. For example, the first resistance portion 10 is formed in a long shape having crank portions to set the resistance value of the first resistance portion 10. As a result, the heat is generated at a center portion of the first resistance portion 10, and a concentrated heat at the center portion is shifted from the fusible portion 12 to the non-fusible portion 13.

With the fuse portion 1, the fusible metal conductor is molded into a plate shape to form the first resistance portion 10 and the second resistance portion 20. A base material of the fuse portion 1 is an alloy of copper (Cu) which constitutes a conductor wire. The fusible portion 12, which is provided on the first resistance portion 10, has a smaller cross-sectional area than that of a wiring of the first resistance portion 10. The low melting point metal chip 32 is heated up to be fused by the overcurrent and is then dispersed into the fusible portion 12 for formation of an alloy phase. The alloy phase formed at the fusible portion 12 has a resistance which is higher than that of the Cu alloy of the fuse portion 1. The alloy phase of the fusible portion 12 is heated up and melted when the overcurrent in the rare-short-circuit range flows. The rare-short-circuit range is from an intermediate range to a small current range in an overcurrent of up to on the order of 200% of a conducted current, that means, a current as twice a rated value.

The low melting point metal chip 32 is a chip which is heated up to melt by the overcurrent so as to be dispersed into the fusible metal conductor for formation of an alloy phase. A material of the low melting point chip 32 is tin (Sn) or the like whose melting point is lower than that of Cu which makes up the fusible metal conductor. The low melting point metal chip 32 has a heat conductivity which is larger than that of the fuse portion 1, so as to absorb heat generated in the fuse portion 1 by the overcurrent.

The holding portion 30 is formed into a cylindrical shape so as to be curled around the low melting point metal chip 32 from both sides thereof and is then crimped to hold the low melting point metal chip 32 to the fuse portion 1. The holding portion 30 forms a contact surface by being crimped to the low melting point metal chip 32, and the current and heat are conducted to the low melting point metal chip 32 via the contact surface. The same material as the material of the fuse portion 1 can be adopted as a material for the holding portion. In the case of the holding portion 30 being made of the same material as that of the fuse portion 1, the holding portion 30 can be molded integrally with the fuse portion 1.

Hereinafter, fusing characteristics will be described which result when the overcurrent in the rare-short-circuit range flows in the fusible link according to the embodiment of the invention.

In the fusible link according to the embodiment of the invention, resistance values of the first resistance portion 10 and the second resistance portion 20 are set to a ratio which enables the shifting of a heat concentration portion of the fuse portion 1, whose temperature is increased by the overcurrent in the rare-short-circuit range, to a portion (the non-fusible portion 13) of the first resistance portion 10 which excepts the fusible portion 12. The resistance ratio enables the shifting of the heat concentration portion to the portion (the non-fusible portion 13) of the first resistance portion 10, which excepts the fusible portion 12. In the ratio of the resistance values of the resistance portions, a resistance value of the first resistance portion 10 is larger than that of the second resistance portion 20. For example, a ratio of the resistance value of the first resistance portion 10 to the resistance value of the second resistance portion 20 ranges from 2 to 1 to 5 to 1. By setting the resistance values of the first resistance portion 10 and the second resistance portion 20 so that the ratio of the resistance value of the first resistance portion 10 to the resistance value of the second resistance portion 20 ranges from 2 to 1 to 5 to 1, as shown in FIG. 2, heat in a range B provided in proximity to a position where the low melting metal chip 32 is disposed can be conducted to a heat dissipating portion 40 having a heat dissipating function. The heat dissipating portion 40 is connected to the second resistance portion 20. Consequently, the temperature of the range B, arranged in proximity to the position where the low melting point metal chip 32 is disposed, is decreased so as to be equal to or lower than a melting point of the low melting point metal chip 32.

Figure 3:
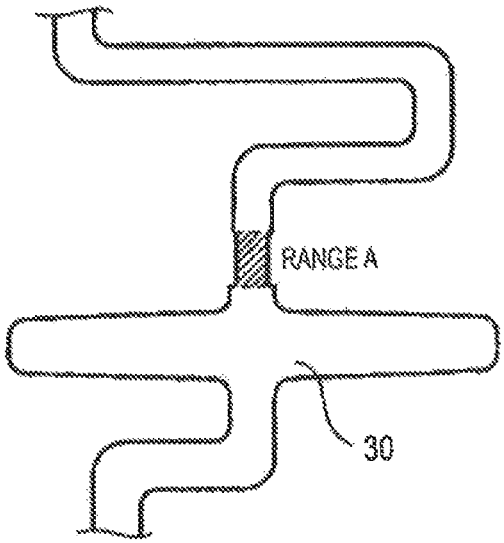
FIG. 3 is an exemplary plan view of a conventional fusible link.
Figure 4:
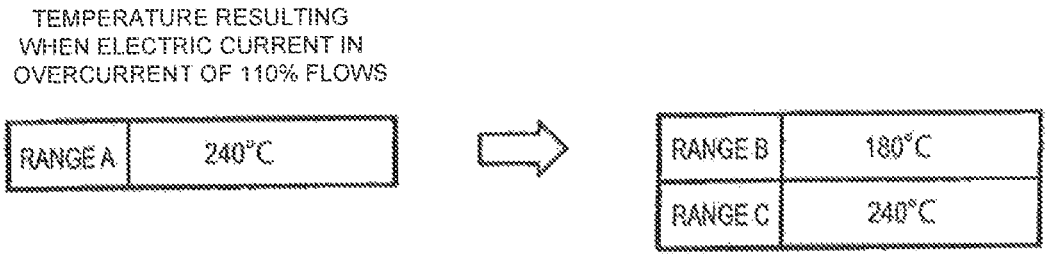
PRIOR ART FIG. 4
FIG. 4 is a table which explains the shifting of a heat concentration portion of the fusible link according to the embodiment of the invention.

As a specific example, FIG. 4 shows the result of a comparison between a temperature of a range A and the temperature of a range B. Range A may be arranged in proximity to a position where a low melting point metal chip 32 is disposed, in a conventional fusible link shown in FIG. 3 where a ratio of resistance values is not set, Range B may be arranged in proximity to the position where the low melting point metal chip 32 is disposed, as shown by the fusible link according to the embodiment illustrated in FIG. 2.

It is seen from a table shown in FIG. 4 that the temperature of the range A in the conventional fusible link is 240° C., which exceeds 220° C. which is a dispersion promoting temperature in the case of the low melting point metal chip 32 thereof being formed of Sn. On the other hand, it is seen that the temperature of the range B in the fusible link according to the embodiment is 180° C., which still does not reach the dispersion promoting temperature of the low melting point metal chip 32. In the fusible link according to the embodiment, however, a temperature of a range C of the first resistance portion 10 which excepts the fusible portion 12 reaches 240° C., meaning that the shifting of the heat concentration portion from the range B to the range C has occurred. Namely, the heat concentration portion has been shifted from the fusible portion 12 to the range of the first resistance portion 10 which excepts the fusible portion 12.

Figure 5:
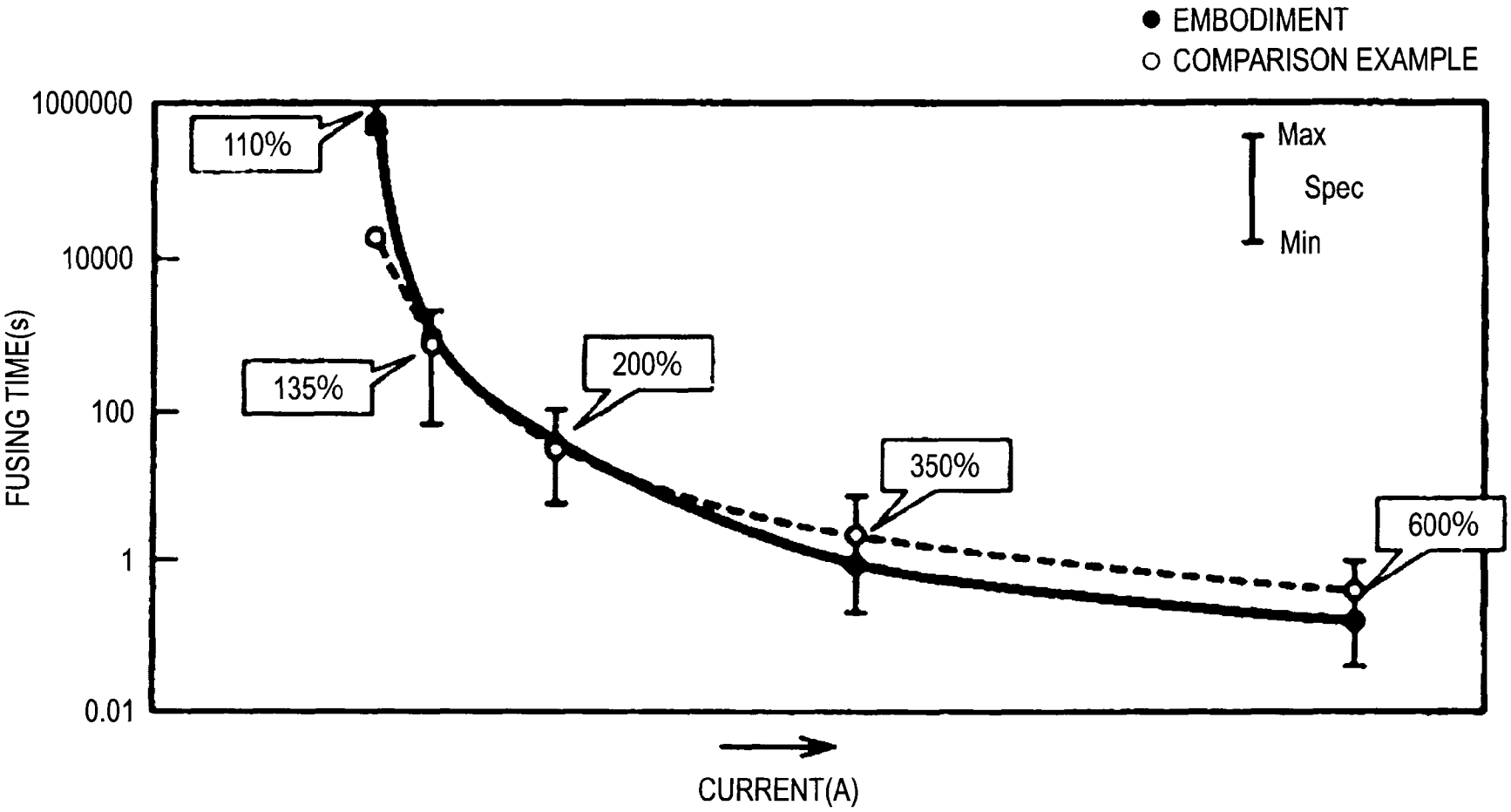
FIG. 5 is a graph showing fusing characteristics of the fusible link according to the embodiment of the invention and the conventional fusible link.

Next, FIG. 5 shows the result of a comparison between the fusing characteristics of the fusible link according to the embodiment of this patent application and the conventional fusible link. In FIG. 5, a ratio of the resistance value of the first resistance portion 10 to the resistance value of the second resistance portion 20 ranges 2 to 1 or more.

As shown in a graph of FIG. 5, when the overcurrent is 110%, it takes on the order of 1000000 seconds for the fusible link according to the embodiment of this patent application to be fused, whereas it takes only on the order of 10000 seconds for the conventional fusible link to be fused. On the other hand, when an overcurrent in the dead-short-circuit range flows, the fusible link whose overcurrent is 200% or more according to the embodiment is fused in a shorter fusing time than that of the conventional fusible link, and this indicates that quick blow characteristics can be set for the former fusible link.

In addition, with the ratio of the resistance value of the first resistance portion 10 to the resistance value of the second resistance portion 10 set to the range from 1 to 1 to 5 to 1, the fusing characteristics can also be set by changing a ratio between resistance values of the fusible portion 12 and the non-fusible portion 13 of the first resistance portion 10. As a specific example, FIG. 6 shows times spent before the fusible portion 12 is fused when the ratio of the resistance value of the fusible portion 12 to the resistance value of the non-fusible portion 13 is changed step by step from 1 to 1 to 5 to 1 in a state that the ratio of the resistance value of the first resistance portion 10 to the resistance value of the second resistance portion 20 changed step by step from 1 to 1 to 5 to 1 when the overcurrent is 110%.

Figure 6:
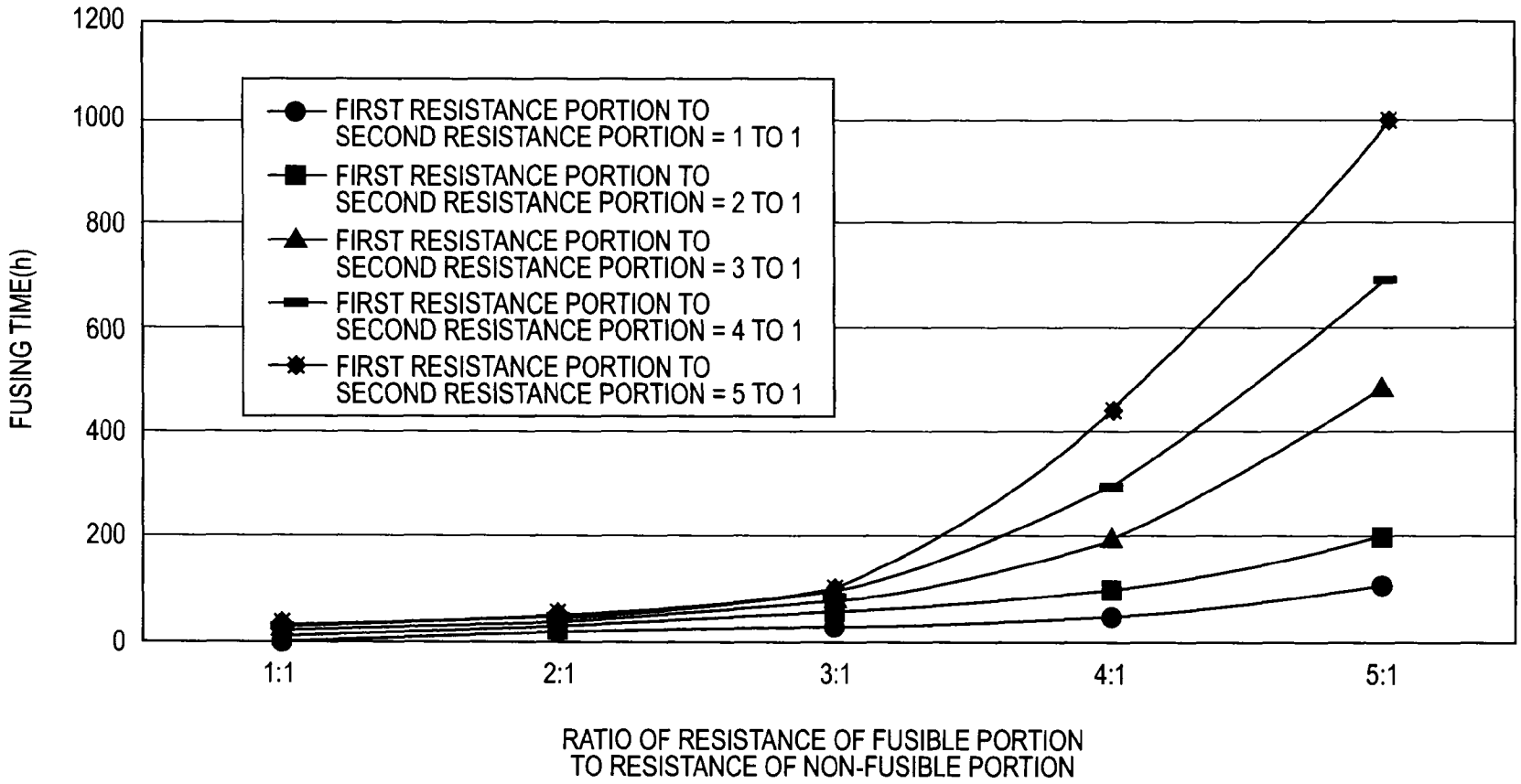
FIG. 6 is a graph showing relationships between change in resistance value and time spent until the fusible link according to the embodiment of the invention is fused.

As shown in a graph of FIG. 6, for the fusible link according to the embodiment, the larger the ratio of the first resistance portion 10, the longer the fusing time at any of the ratios of the resistance value of the fusible portion 12 to the resistance value of the non-fusible portion 13, in a state that the ratio of the resistance value of the first resistance portion 10 to the resistance value of the second resistance portion 20 is set to any of the ratios ranging from 1 to 1 to 5 to 1. In addition, FIG. 6 shows that, for the fusible link according to the embodiment, the smaller the ratio of the fusible portion 12, the quicker the fusible link blows in a state that the ratio of the resistance value of the fusible portion 12 to the resistance value of the non-fusible portion 13 is changed from 1 to 1 to 5 to 1.

According to the fusible link of the embodiment, since the heat concentration portion of the fuse portion 1 whose temperature is increased by the overcurrent in the rare-short-circuit range (in particular, when the overcurrent is on the order of 110%) can be shifted to the range of the first resistance portion 10 which excepts the fusible portion 12, it is possible that the fusing characteristics allow for the fusible link not to be fused for a long period of time when the overcurrent in the rare-short-circuit range flows.

In addition, in the event that the overcurrent is larger than 110%, in particular, in the event that the overcurrent in the dead-short-circuit range is 200% or more, the fusible link according to the embodiment of this patent application and the conventional fusible link are not affected by the dispersion of the low melting point metal chip 32, which is formed of Sn or the like. Because of this, the fusing of those fusible links is not affected. However, in the event that the overcurrent in the dead-short-circuit range, i.e., when overcurrent is 200% or more, flows, with the fusible link according to the embodiment of this patent application, the quick blow characteristics can be set in which the fusing time is made shorter than the fusing time of a conventional fusible link, such as the fusible link shown in FIG. 3.

OTHER EMBODIMENTS

While the invention has been described based on the embodiment thereof, the description and illustration of the embodiment made in the specification and the accompanying drawings which constitute part of the disclosure of the invention should not be construed as limiting the invention. Various alternative forms, embodiments and techniques to carry out thereof will be obvious to those skilled in the art to which the invention pertains from the disclosure of the invention.

For example, it is described in the embodiment that the resistance values of the first resistance portion 10 and the second resistance portion 20 are set to the ratio which enables the shifting of the heat concentration portion of the fuse portion 1 whose temperature is increased by the overcurrent in the rare-short-circuit range to the range of the first resistance portion 10 which excepts the fusible portion 12. As an example of a method for setting the resistance ratio, in the case of the cross-sectional areas of the first resistance portion 10 and the second resistance portion 20 being the same, a desired resistance value ratio can be set by forming the first resistance portion 10 and the second resistance portion 20 to a desired length ratio.

In this way, it should be understood that although not described herein, the invention includes various forms of carrying out the invention. Consequently, the invention is limited only by the claims, which are understood to be reasonable from the disclosure of the invention made herein.

What is claimed is:

1. A fusible link comprising:

a fuse portion that has a first electrical resistance portion and a second electrical resistance portion which are formed of a fusible metal conductor, wherein the first electrical resistance portion has a first resistance value and the second electrical resistance portion has a second resistance value, and wherein the first electrical resistance portion has a fusible portion which is provided in proximity to a connecting portion of the first electrical resistance portion with the second electrical resistance portion and which is adapted to be fused and cut off when the fusible portion is heated up by an overcurrent;

a metal chip whose melting point is lower than a melting point of the fusible metal conductor, and which is adapted to be fused to be dispersed into the fusible portion for formation of an alloy phase when the metal chip is heated up by the overcurrent; and a holding portion that is provided in proximity to the fusible portion for holding the metal chip, wherein the first resistance value is greater than the second resistance value such that a ratio of the first resistance value and the second resistance value ranges from 2 to 1 to 5 to 1 so that a temperature of the first electrical resistance portion is increased by the overcurrent in a rare-short-circuit range; and wherein the second electrical resistance portion is shorter in length than the first electrical resistance portion, wherein the second electrical resistance portion has a first end part connected to the first electrical resistance portion and a second end part connected to a heat dissipating portion, the first end part being opposite to the second end part, wherein the heat of the fusible portion increased by the overcurrent in the rare-short-circuit range is conducted to the heat dissipating portion so that the heat of the fusible portion of the first electrical resistance portion is decreased so as not to fuse the metal chip while maintaining a temperature of a part of the first electrical resistance portion that does not include the fusible portion of the first electrical resistance portion, wherein a width of the heat dissipating portion is greater than a width of a portion of the second electrical resistance portion other than the holding portion, and wherein the rare-short-circuit range of the overcurrent is greater than a rated value and is smaller than a predetermined current that is twice as large as the rated value.

2. The fusible link according to claim 1, wherein the ratio of resistance values of the first electrical resistance portion and the second electrical resistance portion is set so that a temperature at the part of the first electrical resistance portion which excepts the fusible portion is greater than a temperature at the fusible portion.

3. The fusible link according to claim 1, wherein an overcurrent in the rare-short-circuit range is 110% of a rated value.

4. The fusible link according to claim 1, wherein a cross-sectional area of the fusible portion is smaller than that of the part of the first electrical resistance portion which excepts the fusible portion.

5. The fusible link according to claim 1, wherein a resistance of the alloy phase is greater than a resistance of a base material of the fusible metal conductor.

6. The fusible link according to claim 1, wherein a heat conductivity of the metal chip is greater than a heat conductivity of the fuse portion such that the metal chip is configured to absorb heat generated in the fuse portion by the overcurrent.

7. The fusible link according to claim 1, wherein the first electrical resistance portion has a cranked shape and the second electrical resistance portion has a straight shape.

8. The fusible link according to claim 1, wherein quick blow characteristics, for a case where an overcurrent in a dead-short-circuit range flows, are configured to be set so that, based on the ratio of the first resistance value to the second resistance value, the time required for the fusible link to be fused is less than the time required for the fusible link to be fused when the overcurrent is in the rare-short circuit range; and wherein the overcurrent in the dead-short-circuit range is greater than the overcurrent in the rare-short-circuit range.

9. A fusible link comprising:

a fuse portion including a first electrical resistance portion having a first resistance value and a second electrical resistance portion having a second resistance value, wherein the first electrical resistance portion includes:

a fusible portion disposed proximate to a connecting portion; and a non-fusible portion extending from the fusible portion, wherein the fusible portion is configured to be fused when the fusible portion receives an overcurrent;

a metal chip having a melting point lower than a melting point of a material forming the fuse portion, wherein the metal chip is configured to be dispersed into the fusible portion to form an alloy phase when the overcurrent heats the metal chip; and a holding portion disposed proximate to the fusible portion, wherein the holding portion is configured to hold the metal chip, wherein the first resistance value is greater than the second resistance value such that a ratio of the first resistance value to the second resistance value is between 2 to 1 and 5 to 1 so that a temperature of the first electrical resistance portion is increased by the overcurrent in a rare-short-circuit range, wherein the second electrical resistance portion is shorter in length than the first electrical resistance portion, wherein the second electrical resistance portion has a first end part connected to the first electrical resistance portion and a second end part connected to a heat dissipating portion, the first end part being opposite to the second end part, wherein the heat of the fusible portion increased by the overcurrent in the rare-short-circuit range is conducted to the heat dissipating portion so that the heat of the fusible portion of the first electrical resistance portion is decreased so as not to fuse the metal chip while maintaining a temperature of a part of the first electrical resistance portion that does not include the fusible portion of the first electrical resistance portion, wherein a width of the heat dissipating portion is greater than a width of a portion of the second electrical resistance portion other than the holding portion, and wherein the rare-short-circuit range of the overcurrent is greater than a rated value and is smaller than a predetermined current that is twice as large as the rated value.

10. The fusible link according to claim 9, wherein a resistance of the alloy phase is greater than a resistance of a base material of the fusible metal conductor.

11. The fusible link according to claim 9, wherein a heat conductivity of the metal chip is greater than a heat conductivity of the fuse portion such that the metal chip is configured to absorb heat generated in the fuse portion by the overcurrent.

12. The fusible link according to claim 9, wherein the holding portion includes a contact surface configured to conduct current and heat to the metal chip.

13. The fusible link according to claim 9, wherein a temperature at the fusible portion is less than a dispersion promoting temperature of the metal chip at a 110% overcurrent condition.

14. The fusible link according to claim 13, wherein a temperature at the non-fusible portion is greater than the dispersion promoting temperature at a 110% overcurrent condition.

15. The fusible link according to claim 9, wherein the first electrical resistance portion has a cranked shape and the second electrical resistance portion has a straight shape.

* * * * *